US008033728B1

(12) United States Patent
Shatwell

(10) Patent No.: US 8,033,728 B1
(45) Date of Patent: Oct. 11, 2011

(54) METHOD OF CLOSING A BAG

(76) Inventor: Barbara A. Shatwell, Middletown, NY (US)

( * ) Notice: Subject to any disclaimer, the term of this patent is extended or adjusted under 35 U.S.C. 154(b) by 936 days.

(21) Appl. No.: 11/971,671

(22) Filed: Jan. 9, 2008

(51) Int. Cl.
*B65D 33/16* (2006.01)

(52) U.S. Cl. ..... 383/71; 24/30.5 P

(58) Field of Classification Search ..... 383/70, 383/71, 24, 25; 24/30.5 P, 30.5 S, 16 PB, 24/30.5 R
See application file for complete search history.

(56) References Cited

U.S. PATENT DOCUMENTS 2,355,705 A 8/1944 Cohn
2,533,829 A * 12/1950 Merryweather ..... 206/361
3,259,302 A 7/1966 Rocchisani
3,430,754 A 3/1969 Meseke et al.
3,473,292 A * 10/1969 Gaudlitz ..... 53/138.3
3,889,872 A * 6/1975 Lin ..... 383/71
3,997,943 A 12/1976 Jones et al.
5,042,113 A 8/1991 Severson et al.
5,301,696 A 4/1994 Revson
5,697,128 A * 12/1997 Peregrine ..... 24/115 G
5,896,623 A * 4/1999 Martin ..... 24/16 PB
D415,682 S 10/1999 Ball

* cited by examiner

*Primary Examiner* — Jes F Pascua

(57) ABSTRACT

A method of closing a bag includes providing a band. A connector extends into the band and connects together opposite portions of the band and to divide the band into a first loop and a second loop. The flexible bag has a peripheral wall. The peripheral wall has a terminal end having an opening therein. The band is extended around the peripheral wall and the first loop extended into the second loop to tighten the band around the bag and close the bag.

4 Claims, 3 Drawing Sheets

METHOD OF CLOSING A BAG

BACKGROUND OF THE INVENTION

Field of the Invention

The present invention relates to bag closing devices and more particularly pertains to a new bag closing device for retaining a bag containing food in a closed position.

SUMMARY OF THE INVENTION

The present invention meets the needs presented above by generally providing a band. A connector extends into the band and connects together opposite portions of the band and to divide the band into a first loop and a second loop. A flexible bag has a peripheral wall. The peripheral wall has a terminal end having an opening therein. The band is extended around the peripheral wall and the first loop extended into the second loop to tighten the band around the bag and close the bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
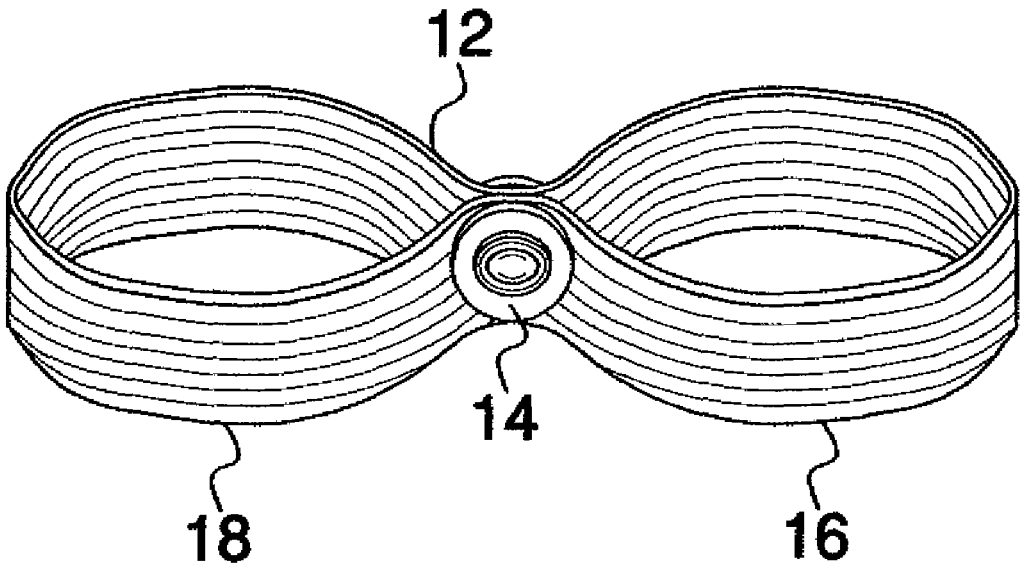
FIG. 1 is a top perspective view of a band of a method of closing a bag according to the present invention.

With reference now to the drawings, and in particular to FIGS. 1 through 5 thereof, a new bag closing device embodying the principles and concepts of the present invention and generally designated by the reference numeral 10 will be described.

As best illustrated in FIGS. 1 through 5, the method of closing a bag 10 generally comprises providing a band 12. The definition of a band includes a loop type structure. The band 12 comprises a resiliently stretchable material.

Figure 2:
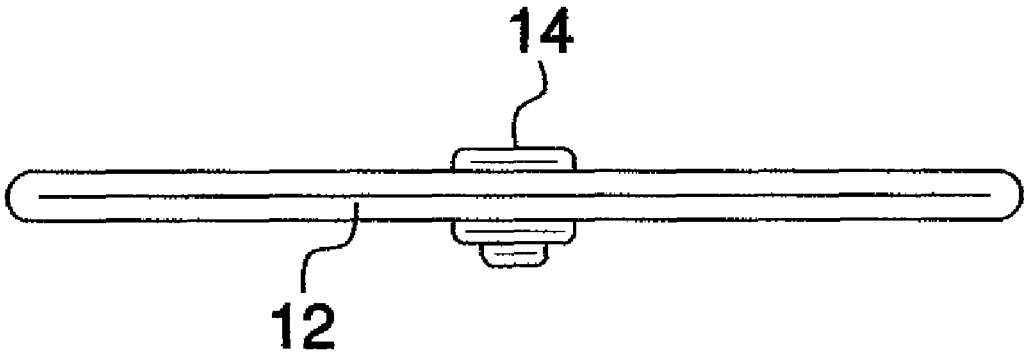
FIG. 2 is a top view of the band of the present invention.
Figure 3:
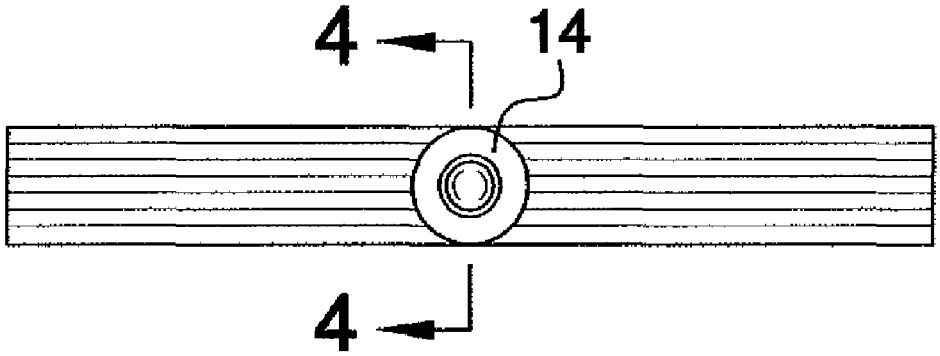
FIG. 3 is a front view of the band of the present invention.
Figure 4:
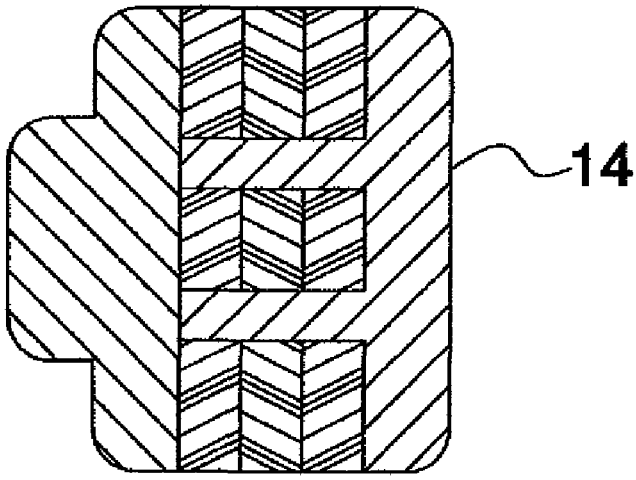
FIG. 4 is a cross-sectional view taken along line 4-4 of FIG. 3 of the present invention.
Figure 5:
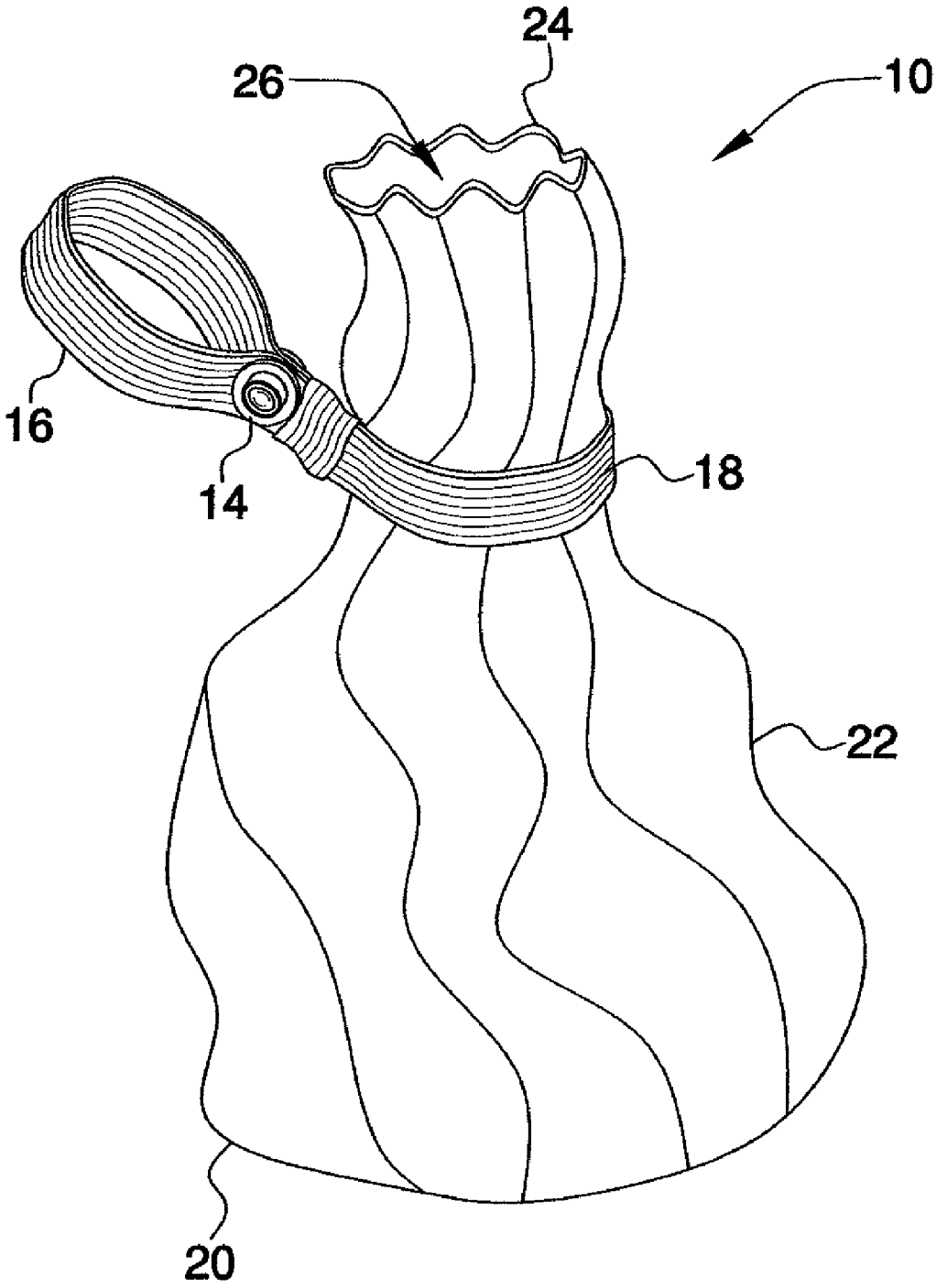
FIG. 5 is a perspective view of the present invention.

A connector 14 extends into the band 12 and connects together opposite portions of the band 12 and divides the band into a first loop 16 and a second loop 18. The loops 16, 18 have an approximately same size with respect to each other. The connector 14 extends outwardly in opposite positions from an outer surface of the band 12 as is shown in FIG. 2.

A flexible bag 20 has a peripheral wall 22. The bag 20 may include any conventional bag used for holding food and will generally comprise plastic type bags. The peripheral wall 22 has a terminal end 24 having an opening 26 therein that extends into an interior of the bag 20.

The band 12 is extended around the peripheral wall 22 to encircle the peripheral wall 22 and the first loop 16 is extended into the second loop 18. This tightens the band 12 around the bag 20, which in turn closes bag 20. The connector 14 may also be extended through the second loop 18. As the connector 14 extends outwardly from the outer surface of opposite sides of the band 12, it forms oppositely positioned shoulders against which the second loop 18 is abutted. This prevents the first loop 16 from moving outwardly of the second loop 18 and retains the band 12 on the bag 20. To remove the band 12, the connector 14 is extended back through the second loop 18 in an opposite direction and the first loop 16 pulled outwardly from the second loop 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of closing a bag, said method comprising the steps of:

providing a band, said band comprising a resiliently stretchable material;

providing a connector extending into said band and connecting together opposite portions of said band and dividing said band into a first loop and a second loop, said connector being in a fixed location on said band;

providing a flexible bag having a peripheral wall, said peripheral wall having a terminal end having an opening therein; and extending said band around said peripheral wall and extending said first loop into said second loop to tighten said band around said bag and close said bag.

2. The method according to claim 1, wherein the step of providing a connector further includes said connector extending outwardly in opposite positions from an outer surface of said band.

3. The method according to claim 2, further including the step of extending said connector through said second loop and abutting said second loop against connector.

4. A method of closing a bag, said method comprising the steps of:

providing a band, said band comprising a resiliently stretchable material;

providing a connector extending into said band and connecting together opposite portions of said band and dividing said band into a first loop and a second loop, said first and second loops having an approximately same size with respect to each other, said connector extending outwardly in opposite positions from an outer surface of said band, said connector being in a fixed location on said band;

providing a flexible bag having a peripheral wall, said peripheral wall having a terminal end having an opening therein;

extending said band around said peripheral wall and extending said first loop into said second loop to tighten said band around said bag and close said bag;

extending said connector through said second loop and abutting said second loop against connector.

* * * * *